United States Patent [19]

O'Hanlon et al.

[11] 4,437,525

[45] Mar. 20, 1984

[54] HAND HELD WATER DRILLING APPARATUS

[75] Inventors: Tom A. O'Hanlon, Tacoma; Peter L. Madonna, Redmond; Gearld F. Wallace, Federal Way, all of Wash.

[73] Assignee: Flow Industries, Inc., Kent, Wash.

[21] Appl. No.: 280,797

[22] Filed: Jul. 6, 1981

[51] Int. Cl.[3] ..... E21B 7/18

[52] U.S. Cl. ..... 175/218; 175/67; 299/17

[58] Field of Search ..... 299/17, 64; 175/67, 175/218, 422

[56] References Cited

U.S. PATENT DOCUMENTS

| | | | |
|---|---|---|---|
| 628,781 | 7/1899 | Farrington et al. | 175/218 X |
| 2,785,875 | 3/1957 | Hayes | 175/67 X |
| 3,203,736 | 8/1965 | Anderson | 299/17 |
| 3,839,875 | 10/1974 | Matsushita | 175/67 X |
| 4,047,580 | 9/1977 | Yahiro et al. | 299/17 X |
| 4,176,883 | 12/1979 | Liesveld | 299/17 |
| 4,306,627 | 12/1981 | Cheung et al. | 299/17 X |

*Primary Examiner*—Ernest R. Purser

*Attorney, Agent, or Firm*—Don R. Mollick; Gregory Moravan

[57] ABSTRACT

A hand held fluid jet drilling apparatus is described. The drill includes an elongated drill stem with a fluid jet nozzle on one end and a motor on the other end. High pressure fluid is supplied to the drill from an external power pack which also produces compressed air. The drill includes a high pressure swivel which allows the motor to rotate the nozzle while a continuous supply of fluid is present. The drill stem is spring mounted to provide protection to the operator. The swivel may also operate as an on-off valve which supplies flushing fluid while the drill is off. The drill is operable as a drill, reamer or slotting tool by suitable arrangement of controls. A second embodiment is illustrated which provides for continuous flushing with low pressure fluid during operation. The drill is also attachable to mechanical feed systems to extend face coverage.

9 Claims, 3 Drawing Figures

HAND HELD WATER DRILLING APPARATUS

BACKGROUND OF THE INVENTION

1. Field of the Invention

This invention pertains to drilling apparatus, particularly water jet drilling apparatus, with still greater particularity, to hand held water jet drilling apparatus for drilling hard materials, such as, rock.

2. Description of the Prior Art

In mining and quarrying operations it is often desirable to drill holes in rock or other hard substances. The holes are used for placement of explosives or for various types of bolts used for supporting the roof of a tunnel. Several types of approaches have been made to create the tools required for such drilling.

Mechanical drills have commonly been used for drilling holes in mining applications. In the most common type of drill, a drill rod is repeatedly impacted to drive the drill against the rock. There is commonly a slight twisting movement at the same time. The power to impact the drill is commonly applied by compressed air. Drills of this type can cut effectively through hard rock, but produce a large amount of noise and dust. Additionally, a force must be applied to the drill to keep the bit in contact with the rock. This force is not insignificant and often requires a mechanical holder or feed for the drill.

Difficulties with the impact type of drill have led to the development of various types of rotary drills. Those drills operated on the same principle as a twist drill, or are similar to the rotary bits used in oil and gas drilling. In this type of drill, a rotating bit is held against the rock face, and a hole is bored. This type of drill produces a lower volume sound than the impact drill, but still must be held against the rock with a significant force.

Both impact and rotary drills often have a provision for flushing of the hole drilled by a fluid. The fluid may be water or a drilling mud, or even compressed air. The fluid is used to clear the hole and remove chips, and does not function as a cutting tool. Additionally, the fluid can aid in cooling the bits. While the use of a fluid reduces dust, the noise and force problem of conventional drills are not affected.

In all mechanical type drills there is a bit that is in contact with the rock. Such bits are subject to wear and require frequent replacement. Additionally, the current equipment contributes in some degree to the safety problems in mining, as such drills require exposed, rapidly moving parts, which may present a hazard.

SUMMARY OF THE INVENTION

The invention provides a hand held water jet drilling and apparatus. The actual cutting of the rock or other substance, is accomplished solely by the action of an ultra high pressure water jet. No cutting surfaces are thus in contact with the rock or work piece. The drill is capable of high speed cutting in a wide variety of substances. Much less noise is generated by the drill than conventional drills and drilling methods. As a consequence of the use of a water jet for cutting, little dust is generated, greatly improving the working environment in the area of the drill. Safety features of the drill prevent accidental contact with the cutting jet.

The invention is basically comprised of three subassemblies. The first subassembly, a nozzle, provides a housing for the jet forming elements and fixes the direction of the jets. The nozzle is adapted to be rotated which also results in the rotation of the cutting jets. The second subassembly, a body subassembly, houses the components of the invention. The body provides an elongated stem which acts as a safety feature to prevent contact with the cutting jets. A motor may be attached to the body to rotate the nozzle and associated components. The body may be made, in part, of flexible material allowing the drill to be bent. If the drill is bent, a hole may be drilled that is longer than the headspace. The final subassembly is a swivel on-off valve. By combining the functions of a valve and swivel, the invention may be hand held. The swivel is within the body subassembly, and connected to the nozzle by a supply tube. The swivel provides an on-off valve of low actuation force by use of counterbalanced forces and the use of flow properties of materials at high pressures.

The invention is also capable of operating in a slotting or reaming mode. To ream, a hole is first drilled into the surface. The drill is then reintroduced into the hole which is reamed to a greater diameter. To slot, a hole is also first drilled. The tool is then introduced into the hole with the motor shut off. As a result, a slot is cut into the sides of the hole that is useful in certain mining application. Neither of these operations are possible with conventional drills.

DESCRIPTION OF THE PREFERRED EMBODIMENT

Figure 1:
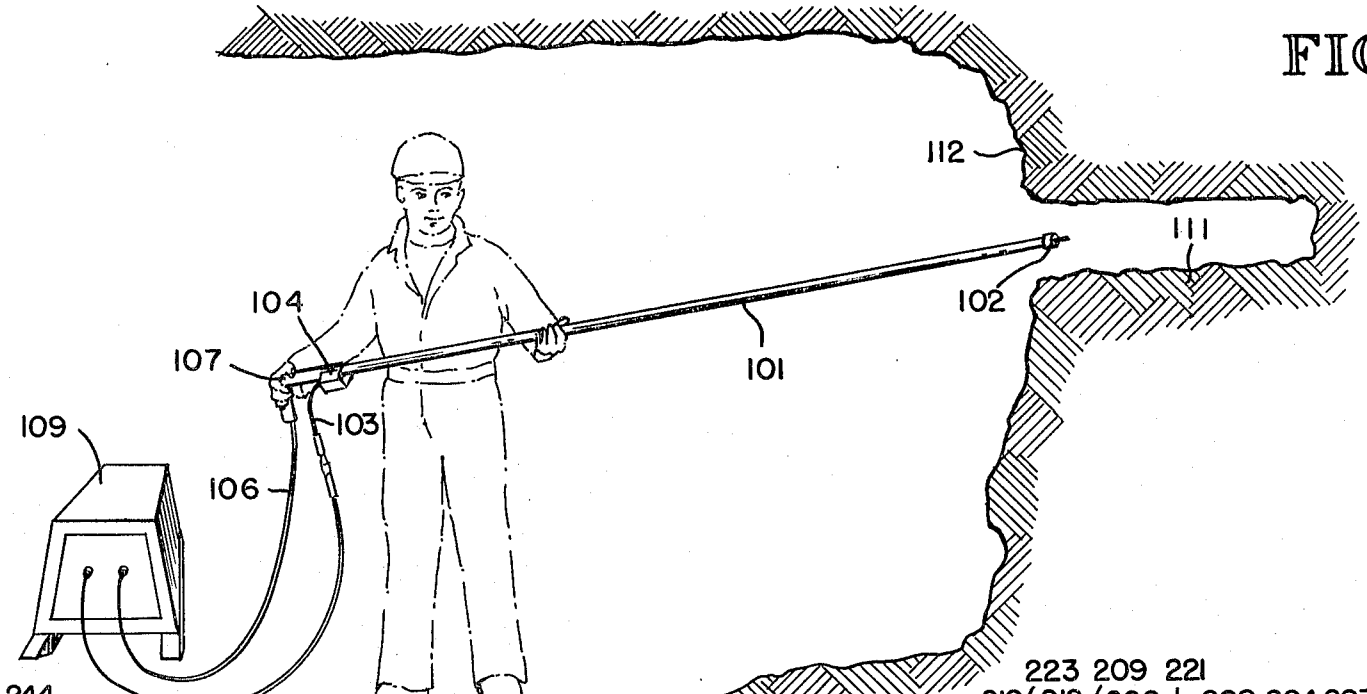
FIG. 1 is a perspective view of the invention in a working environment.

FIG. 1 is a perspective drawing of the invention in a working environment. The drill of the invention is seen to be primarily an elongated rod 101, having a nozzle 102 at one end. The other end of the drill is connected to two hoses 103,106. The first hose 103 supplies high pressure fluid from a power pack 109 to a high pressure fitting 104 on the drill. The pressure of fluid used may be from 5,000–50,000 psi, and is dependent upon the type of material being cut. In uranium mining applications, for example, typical pressures are from 12,000 to 35,000 psi. A second line 106 supplies compressed air to a pneumatic motor 107 attached to the drill. Motor 107 rotates nozzle 102 to provide drilling action. While motor 107 is pneumatic in this application, an electric or hydraulic motor could also be used. The motor used, requires about 20 cubic feet per minute of air.

Power pack 109 includes a hydraulic intensifier pumping system that raises the fluid pressure to that necessary to operate the drill. An air compressor supplies compressed air to the drill through hose 106. The power pack may be powered electrically, and located at a convenient position. Hoses 103,106 may be as long as 500 feet. The drill is capable of drilling, reaming, and slotting operations.

FIG. 1 shows a cross section of a hole 111 drilled and reamed into rock face 112. The drill will drill a hole equal in depth to the drill's length, less swivel and motor. The drill body 101 may be constructed of a flexible material allowing the drill to be bent to drill holes for roof bolts that are longer than the headspace. The drill stem length is dependent upon the size of hole needed to be drilled, and is commonly 6–10 feet. The weight of a 6' drill stem is 6 lbs., and weight of the drill is 6 lbs., making a total of 12 lbs., which is much lighter than conventional drills, and an easy weight for hand use.

Figure 2:
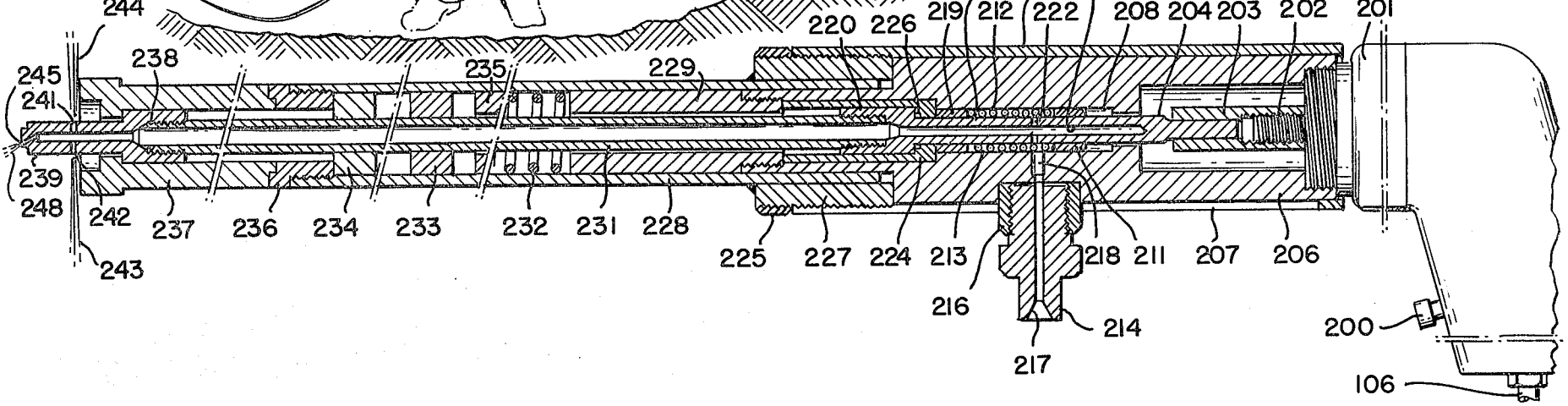
FIG. 2 is a elevation section view of the invention in drilling position.

FIG. 2 is a section elevation view of a first embodiment of the invention. The figure is broken at three points to shorten the length, but it is understood to be similar in length to FIG. 1.

A pneumatic motor 201 is located at one end of the drill. Motor 201 is provided with an on-off valve 200 to control air supplied by line 106. Possible substitutes for motor 201 include electric or hydraulic motors. The shell of motor 201 is attached to the swivel housing 206. In the embodiment shown, attachment is by means of threads, but other equivalent means may be used. The output shaft 202 of motor 201 is attached to a coupling 203. Coupling 203 threadably attaches to shaft 202, and slidably attaches to valve spool 204, thus allowing motor 201 to rotate spool 204 while allowing spool 204 to be moved in a direction axial to such rotation. This may be accomplished by a hexagon, key, or spline connection. Valve body 206 forms a housing for the mechanical components and contains the high pressure present. Valve body 206 is covered by a slidable body cover tube 207, and is thicker in that portion 209 exposed to high operating pressures. A passage 218 in this area connects the interior 213 and exterior of valve body 206. The outer end of passage 218 is equipped with a connector 216 to which a high pressure fitting 214 may be attached. The connection is such, that fluid in a hose attached to fitting 214 will pass through the interior 217 of fitting 214 into passage 218, and then to the interior of valve body 206. The interior 213 of the high pressure section 209 of valve body 206 is sealed by seals 211, 219 from the external environment. A spring 212 urges seals 211,219 against two bearing 208,224. Seals 211, 219 seal to the interior of valve body 206 and the exterior of spool 204. Spool 204 is supported for rotation and translation in a direction axial to such rotation by a rear bearing 208 and a front bearing 224. Bearings 208 and 224 also act as stops for seals 211 and 214, respectively. Bearing 208 is in turn stopped by a step in valve body 206. Bearing 224 is dismountably retained by a bearing retainer 229 which allows disassembly of the drill for cleaning or replacement of seals 211 and 219. Spool 204 provides a front section 220 of enlarged diameter to rotate in front bearing 224. Section 220 has flat areas to allow passage of fluid and an internal thread to allow attachment of a high pressure supply tube 231. A hole 221 extends through most of spool 204 and communicates with tube 231. Two sets of ports connect hole 221 to the exterior of spool 204. The first or forward set 223 is near enlarged portion 220, and the second or rear set 222 is toward the other end. An elongated drill stem 228 is attached to housing cover tube 207 by means of a threaded adapter 227, which is welded to drill stem 228 and threaded to cover tube 207. A locking ring 225 locks the connection, but allows disassembly when desired. Drill stem 228 is free to slide on bearing retainer 229 and a portion of valve body 206, and is normally urged away from motor 201 by a spring 232 which is compressed between bearing retainer 229 and a spring stop 235 attached to drill stem 228. High pressure supply tube is centered and allowed to rotate by bearing 233,234 attached to drill stem 228. Bearings 233 and 234 contain passages (not shown) to allow passage of fluid up drill stem 228. If desired, drill stem 228 and high pressure tube 231 may be made of flexible material to allow bending the drill. A stand off 237 is threadably attached by an adapter 236 to the end of drill stem 228. Stand off 237 is normally made of a hard material, such as, tungston carbide, to prevent wear, and is normally brazed to adapter 236. The length of stand off 237 & adapter 236 determine the size of hole drilled and is, therefore, replaceable. A cutting nozzle 239 is dismountably attached to the end of high pressure supply tube 231, and rotatably mounted to stand-off 237. Nozzle 239 contains jet nozzles 241,242 which produce jets 243,244 which impinge on the surface of the material being drilled shortly in front of stand-off 237. An additional jet 245 emerges from the front of nozzle 245.

The drill in FIG. 1 is shown in the on position. In this position high pressure fluid from a power pack enters the interior 217 of connector 214 and flows through passage 218 into the interior 212 of valve body 206. The fluid then flows through ports 222 and 223 into the interior 221 of spool 204. From spool 204 the fluid traverses high pressure supply tube 231 to nozzle 239 where the fluid emerges from jet nozzles 241, 242 and 245 to form cutting jets 243,244. When valve 200 is depressed, motor 201 rotates shaft 202, which in turn rotates stem 204 and attached high pressure supply tube 231 and nozzle 239 to produce the drilling action.

To place the drill in the on position the operator must pull cover tube 207 toward motor 201 until adapter 227 abuts valve body 206. This action causes the step on stand off 237 to push nozzle 239 toward motor 201. The motion of the nozzle pushes high pressure tube 231 and spool 204 into the FIG. 2 position.

In the off position, port 223 is located in a step 226 on bearing 220. The rear of nozzle 239 is in contact with bearing 234 which acts as a nozzle stop. The cutting jets 246,241,242 are thus covered by stand off 237. In the off position fluid enters through passage 216 to passage 218 into area 212 of valve body 206. The fluid then enters port 222 and the interior 221 of spool 204. Since there is an alternative path most of the fluid leaves spool 204 via port 223 into step 226. The fluid then passes the flats on area 220 of spool 204 and travels between pressure tube 231 and drill stem 228, using the passages in bearings 233 and 234. The fluid then exits at low pressure from the front of stand off 237. The fluid, thus, performs a flushing function in the off position. The drill is held in the off position by spring 232, preventing contact with jets 243,244 and 245, and acting as a dead man's switch, since constant pressure is required to expose and activate the jets.

To drill, the drill is put into the FIG. 2 position by pulling cover tube 207 or drill stem 228 toward motor 201, and activating valve 200. To slot, the drill is put into the FIG. 2 position, but valve 200 is not activated, and the drill inserted into a pre-drilled hole. Jets 243 and 244 will cut slots normal to the hole as they are not rotated. To ream, the drill is simply run through a pre-existing hole in the FIG. 2 position with valve 200 activated. The same tool is thus capable of drilling, slotting and reaming operations.

Figure 3:
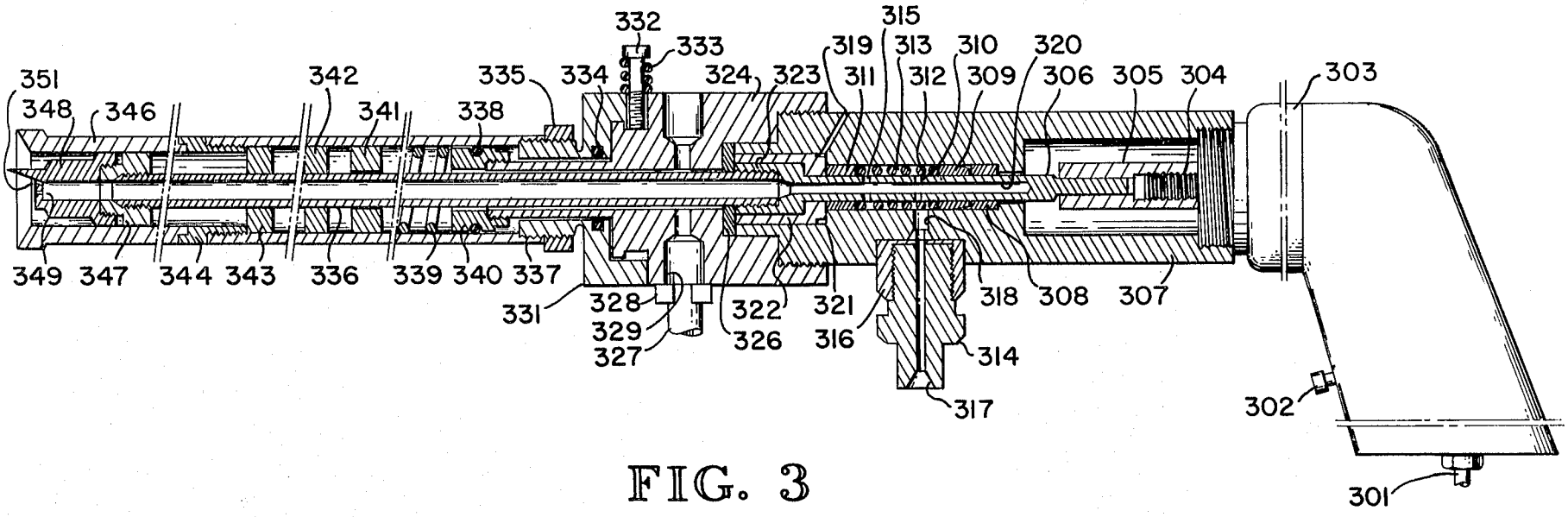
FIG. 3 is a elevation section view of a second embodiment of the invention.

FIG. 3 is a section elevation view of a second embodiment of the invention. The drawing is broken to save space, but is realized to be similar in length to FIG. 1.

A pneumatic motor 303 having an on-off valve 302 and air connection 301 to provide rotation is similar to the FIG. 2 embodiment. The shaft 304 of motor 303 is connected to a spool 306 by a connector 305. Connector 305 may, but need not permit sliding of spool 305 relative to shaft 304. Motor 303 is attached to a swivel body 307, which forms a housing for the swivel. The spool 306 is rotatably mounted to swivel body 307 by a front bearing 322 and a rear bearing 308. Unlike the FIG. 2 configuration, spool 306 does not slide. The interior 313 of swivel body 307 between bearings 322 and 308 is intended to contain high pressure, and is sealed by seals 309 and 311 at either end. Seals 308 and 311 seal to the exterior of spool 306 and the interior of swivel body 307. Seals 309 and 311 are urged against bearings 308 and 322, respectively, by a spring 312 in interior 313 of swivel body 307. Interior 312 is connected to a high pressure connector 314 by a passage 318. Connector 314 attaches to swivel body 307 by a bushing 316, allowing high pressure fluid to enter interior 313. Any leakage past seal 311 is drained off via a weep hole 319, which empties into a cutout 321 on bearing 322. Spool 306 has a hollow core 320 connected to interior 313 of swivel body 307 by ports 315 and 3. An enlarged front section 323 of spool 306 is held in position by bearing 322 and a thrust bearing 326. A high pressure supply tube 336 also attaches to enlarged section 323 of spool 306 and is supported by bearings 322 and 326. A flush housing 324 is attached to the end of swivel body 307 by threads in this embodiment. Flush housing 324 contains a recess to hold thrust bearing 3 and a plurality of ports 329 to allow introduction of low pressure flushing fluid from line 327 connected to flush housing 324 by bushing 328. In some embodiments all but one port is plugged. Port 329 opens to the interior of flush body 324 surrounding high pressure supply tube 336. The stem adapter 331 is shown locked to flush housing 324. Stem adapter 331 is provided with a screw 332 that is loaded by a spring 233 to lock into a groove on flush housing 324. A seal 334 keeps dirt out of the area where stem adapter 331 slides on flush housing 324. An elongated drill stem 337 is attached to stem adapter 331 by a lock nut 335. Lock nut 335 allows adjustment of the stand off distance. A seal holder 340 is attached to one end of flush housing 324 to hold seal 338 and act as a rear spring stop for spring 339. Holder 340 also prevents drill stem 337 from falling off flush housing 324. Seal 338 prevents fluid from the interior of drill stem 337 from reaching the area between stem adapter 331 and flush housing 324. The front of spring 339 is stopped by a spring stop 341. The high pressure supply tube 336 is held in drill stem 337 by bearing 342 and 343 which allow rotation and passage of fluid up drill stem 337. A stand off 346 is mounted to the front of drill stem 337 by an adapter 344 as in FIG. 2. A nozzle 348 having cutting jets 349 and 351, is mounted to high pressure supply tube 336 by a nozzle adapter 347.

To drill with the FIG. 3 embodiment, the operator turns on the flushing fluid supply which is connected to the power pack by a separate hose (not shown). The flush-fluid then flows up line 327 into port 329, thence to the space between flush body 324 and high pressure tube 336. The flushing fluid then traverses drill stem 337, around nozzle adapter 347 and nozzle 348 which have flat areas to allow passage of fluid. The flushing fluid removes any debris that may be in the drill. The power pack senses the drop in flush fluid pressure and opens a valve admitting high pressure fluid. The high pressure fluid flows up a line (not shown) connected to connector 314 and enters swivel body 307. From the interior 313 the fluid enters spool 306 through ports 315 and 320, thence to high pressure supply tube 336, and exits, forming jets 349 and 351. In the off position jets 349 and 351 will be impinging on stand off 346. To drill the operator presses the front of stand off 346 against the work surface, and opens valve 302, which results in rotation of nozzle 348. The pressure on stand off 346 presses back drill stem 337 and exposes jets 349 and 351 allowing drill to proceed.

To slot or ream, the operator pulls back stem 337 until screw 332 locks on flush housing 324, exposing jets 349 and 351. The flush fluid is then turned on, which also activates the cutting fluid as described above. The drill is then inserted into a pre-drilled hole, if slotting is desired. To ream, the same process is followed, but valve 302 is also opened.

It will be apparent that the embodiments shown are only exemplary, and that various modifications in construction and arrangement may be made without departing from the scope of the invention as defined in the subjoined claims. A mechanical feed system such as a feed leg or a drill feed may also be added. In this manner the handdrill may be converted for use on mechanical positioners which are capable of extending face coverage beyond the reach permitted by handheld operation.

01430

What is claimed is:

1. A drill for drilling hard materials comprising:

an inlet connectable to a source of high pressure fluid; and, a high pressure swivel connected to said inlet for allowing rotation relative to said inlet; and, a nozzle for forming high pressure cutting jets when supplied with high pressure fluid; and, a supply tube connecting said high pressure swivel and said nozzle for supplying said nozzle with high pressure fluid; and, motor means for rotating said nozzle; and flushing means for removing chips from any hole bored by said drill; and, means connecting said flushing means to the outside of said supply tube.

2. A drill as in claim 1 further comprising:

deadman means for preventing contact with jets emerging from said nozzle, and, means connecting said deadman means to said swivel.

3. A drill as in claim 1 wherein said swivel means is further operable as an on-off valve for relieving pressure on said high pressure supply tube.

4. A drill as in claim 3 wherein said swivel means is connected to said flushing means to provide a stream of low pressure fluid while in the off position.

5. A system for drilling, slotting and reaming holes into a hard substance comprising:

means for supplying a stream of high pressure fluid; and, an elongated drill stem with a nozzle at one end and a swivel joint at the other end; and, motor means connected to the swivel joint of said drill stem for rotating said nozzle; and, a line connecting said swivel joint and said high pressure supply means; and, deadman means connected to said drill stem movable between an on and off position for preventing contact with fluid emerging from said nozzle by covering said nozzle; and, spring means associated with said dead man means in said drill stem for holding said deadman means in the off position without the operator's intervention and reducing the pressure supplied to said nozzle.

6. A system as in claim 5 wherein said motor means is a pneumatic motor.

7. A drill system as in claim 5, further comprising:

flushing means in said drill stem for removing chips from a hole created by said system.

8. A drill system as in claim 7, wherein said flushing means is connected to said high pressure supply means in such a manner that activation of said flushing means activates said high pressure supply means.

9. A drill system as in claim 7, wherein said flushing means is connected to said deadman means in such a manner that said flushing means is activated when said deadman means is in the off position.

* * * * *